US005720594A

United States Patent [19]

Snow

[11] Patent Number: 5,720,594

[45] Date of Patent: Feb. 24, 1998

[54] FAN OSCILLATING IN TWO AXES

[75] Inventor: Daniel Snow, Nevada City, Calif.

[73] Assignee: Holmes Products Corp., Milford, Mass.

[21] Appl. No.: 572,800

[22] Filed: Dec. 13, 1995

[51] Int. Cl.[6] ..... F04D 29/36

[52] U.S. Cl. ..... 416/100; 416/116; 416/170 R; 416/246

[58] Field of Search ..... 416/98, 100, 108, 416/109, 110, 112, 116, 170 R, 244 R, 246, 247 R; 74/50; 248/188.5, 413; 403/122

[56] References Cited

U.S. PATENT DOCUMENTS

| | | | |
|---|---|---|---|
| 2,742,225 | 4/1956 | Guardado | 416/100 |
| 4,482,266 | 11/1984 | Kaneko | 403/122 |
| 4,732,539 | 3/1988 | Shin-Chin . | |
| 4,743,737 | 5/1988 | Tateishi . | |
| 4,850,804 | 7/1989 | Huang . | |
| 5,163,814 | 11/1992 | Hutter et al. . | |
| 5,256,039 | 10/1993 | Crawford . | |
| 5,370,500 | 12/1994 | Thompson . | |
| 5,429,481 | 7/1995 | Liu . | |
| 5,431,544 | 7/1995 | Hsu et al. . | |
| 5,435,696 | 7/1995 | Cunning . | |
| 5,458,462 | 10/1995 | Shao . | |
| 5,556,256 | 9/1996 | Shao . | |

FOREIGN PATENT DOCUMENTS

| | | | |
|---|---|---|---|
| 0114327 | 8/1984 | European Pat. Off. | 403/122 |
| 0162795 | 9/1983 | Japan | 416/170 C |
| 0081496 | 5/1985 | Japan | 416/100 |
| 0226599 | 10/1986 | Japan | 416/100 |
| 0066492 | 3/1989 | Japan | 416/246 |
| 0138488 | 6/1991 | Japan | 416/246 |

*Primary Examiner*—Christopher Verdier
*Attorney, Agent, or Firm*—Hoffmann & Baron, LLP

[57] ABSTRACT

A portable fan providing oscillation in two axes. Oscillation may occur simultaneously in two axes, or in one selected axis. Two oscillation mechanisms are provided, each having its own oscillation motor and each being selectively operable independent of the other. Optionally, the main fan motor may be employed to power one oscillation mechanism. The fan has a base for desk top support, or a base and extensible column for floor support, or a bracket for permanent mounting. All embodiments have controls for controlling the fan motor and the oscillation motor or motors, and a limited tilting feature for maintaining the fan blade at an angle to the base or bracket.

9 Claims, 5 Drawing Sheets

FAN OSCILLATING IN TWO AXES

BACKGROUND OF THE INVENTION

1. Field of the Invention

The present invention relates to a portable fan which is supported on a horizontal surface, such as a floor or tabletop. The fan oscillates in the sense of causing the attitude of the fan blade to vary periodically and regularly. Most significantly, the direction of air discharge is caused to vary both vertically and horizontally.

In alternative embodiments, the fan has one oscillation mechanism for causing oscillation of discharge direction to vary in both vertical and horizontal directions, and in another the fan has two independent oscillation mechanisms. In the latter case, one mechanism causes horizontal oscillation, and the other mechanism causes vertical oscillation. In the latter case, direction of oscillation is selected by the user.

The fan generally comprises a main motor mounted upon a movable support chassis, a fan blade supported on the shaft of the main motor, a stationary stand for supporting the fan on a floor or tabletop, oscillation mechanisms, and controls. The oscillation mechanisms are motorized, and employ the eccentric portion of a crank entrapped within and moving along a groove to cause the support chassis to oscillate with respect to the stationary stand.

2. Description of the Prior Art

Effectiveness of a fan is dependent in part upon the direction of discharge of air, which normally is further dependent upon attitude of the fan. In many instances, it is desirable to cause the fan to sweep repetitively through an arc in a horizontal plane, or to oscillate. This arrangement spreads the benefits of ventilation to a wide area while employing a fan of limited size and power.

Even more benefit is derived from adjusting the fan attitude in the vertical plane. This feature enables more precise adjustment of discharged air. A number of prior art fans provide both vertical adjustment and horizontal oscillation.

Examples are seen in U.S. Pat. Nos. 4,732,539, issued to Shao Shin-Chin on Mar. 22, 1988, and 5,435,696, issued to Joseph M. Cunning on Jul. 25, 1995, which describe fans which both oscillate in one axis, and tilt in a second axis. However, the tilting function is static, and once the attitude determined by the tilting function is set, it does not vary. By contrast, the present invention provides for oscillation in two axes.

U.S. Pat. No. 5,163,814, issued to Frank Hutter et al. on Nov. 17, 1992, sets forth a drive assembly which accommodates a variety of fan attitudes. The drive comprises a pair of beveled wheels frictionally engaging the fan head. While the frictional drive is compatible with a conventional oscillation mechanism, there is no simultaneous oscillation occurring in two different planes. By contrast, oscillation occurs in two different planes. By contrast, the present invention lacks beveled wheels, and instead provides a pair of motorized crank based oscillation assemblies, each influencing attitude in one of two complementary planes. The novel arrangement provides simultaneous oscillation in two planes, unlike the arrangement of Hutter et al.

None of the above inventions and patents, taken either singly or in combination, is seen to describe the instant invention as claimed.

SUMMARY OF THE INVENTION

The present invention improves upon prior art fans by providing oscillation about two different axes in an otherwise conventional powered fan having a motor and a fan blade mounted on the motor output shaft. While the two axes may be mutually oriented as desired, it is contemplated that the most desirable arrangement will be that one axis be horizontal, and that the other axis be vertical.

There are several different ways to effect oscillation about two axes. One way is to connect two separate oscillation mechanisms to respective output shafts of two motors. Normally, both oscillation mechanisms will operate simultaneously, which would cause the motor output shaft to describe a frustocone as it responds to the compound input motions.

In a preferred embodiment, the oscillation mechanisms are independent of one another. Thus, each oscillation mechanism may be provided with its own control, the two motors being independently controlled to allow selection of oscillation about one axis, oscillation about the other axis, oscillation about both axes, or no oscillation.

It would also be possible to employ the fan motor to power one of the oscillation mechanisms, if it were desired that oscillation should always occur during fan operation. In this example, oscillation about a vertical axis would most likely be provided, since oscillating fans conventionally oscillate about a vertical axis, or in a horizontal plane.

It is contemplated that a fan improved by the present invention will find widest application as a general purpose, portable fan. For this reason, the fan is provided with a stand or base having a flat bottom surface, for supporting the fan on a floor or desk top. For floor support, the stand includes an extensible column. However, the invention may also be practiced in a fan having an integral bracket for permanent mounting to a vertical or horizontal surface.

In all embodiments, the fan has controls, preferably push button or touch responsive controls, governing on-off and speed control of the fan, and selection of oscillation options. Oscillation options include whether to cause oscillation selectively in either of the available selectable axes, oscillation in both axes, or no oscillation.

In order to accomplish independent oscillation, the motor and fan blade assembly is pivotally supported on a first frame. The motor and fan blade assembly can oscillate relative to the first frame. The first frame is, in turn, pivotally supported on the base or stand of the fan, and can oscillate relative to the base or stand. Since the first frame and base or stand are independently pivotable, oscillation may proceed selectively in either component or in both.

The fan is provided with a tilting feature, which maintains the motor and fan assembly at an attitude wherein the axis of the fan blade deviates from a horizontal direction. A second feature limits the degree of tilt to that beyond which the fan would be rendered ineffective due to vertical discharge of air.

In embodiments intended for desk or table top support, control push buttons or touchpads are preferably located on the base. This is most suitable since the fan preferably has apparatus for tilting the motor and fan blade assembly on the base, and it is preferable to locate controls in a constant or fixed location on the fan.

Accordingly, it is a principal object of the invention to provide a fan which oscillates about two axes.

It is another object of the invention that oscillation about each axis be controllable independently of oscillation about the other axis.

It is a further object of the invention to provide a stand, base, or bracket for supporting the fan on or fastening the fan to an environmental surface.

Still another object of the invention is to provide manual controls for controlling fan operation and speed, and for selectively controlling oscillation.

An additional object of the invention is to provide an extensible base for floor supported, portable applications.

Another object of the invention is to enable tilt of the fan motor and blade assembly on its base while limiting tilt thereof to a degree beyond which the fan would be ineffective due to vertical discharge of air.

It is again an object of the invention to provide touch responsive controls.

Yet another object of the invention is to locate manual controls in the base of the fan in tabletop supported applications.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
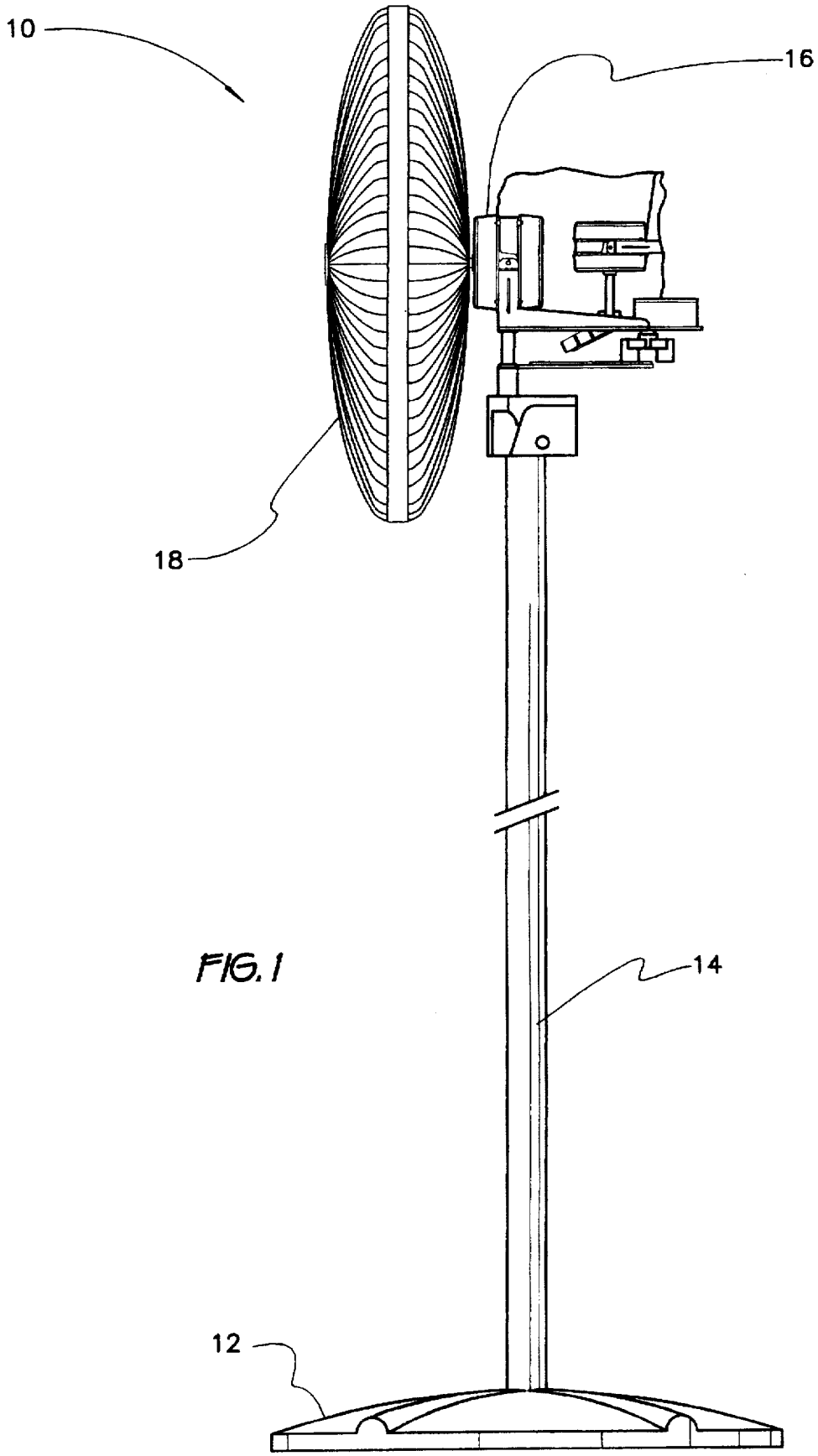
FIG. 1 is a perspective view of the invention.

FIG. 1 is a perspective view of the novel fan 10. Visible in this view are a base 12, vertical column 14, motor 16, and fan blade guard 18. Also seen are oscillation mechanisms which provide the principal novel features.

Figure 2:
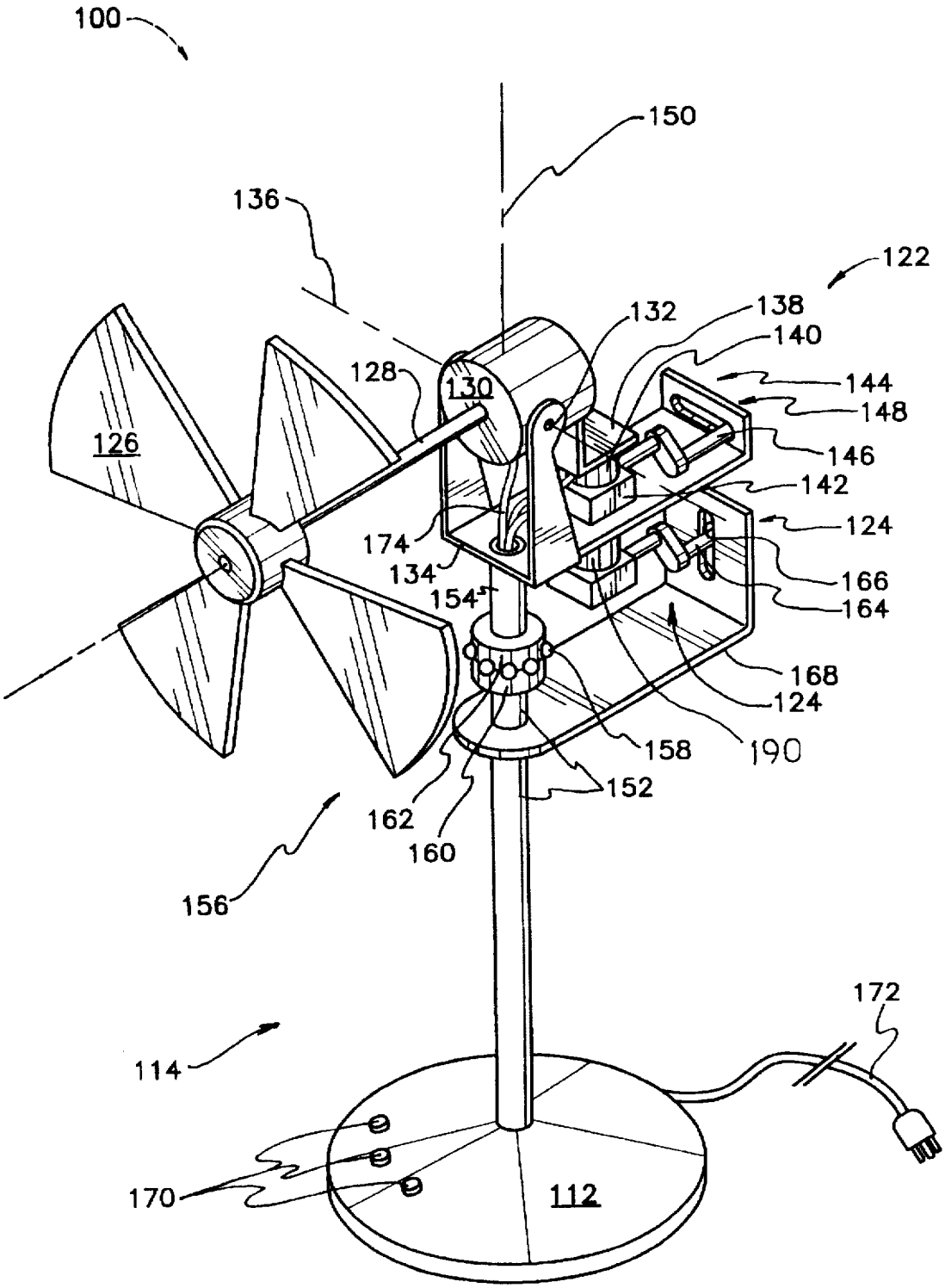
FIG. 2 is perspective view of an alternative embodiment of the invention incorporating two oscillation motors.

FIG. 2 illustrates oscillation mechanisms in greater detail. An oscillation mechanism is a mechanism which converts an input motion, such as circular or rotary motion from a motor, into oscillation. For the purposes of this discussion, oscillation will be understood to refer to a repetitive motion causing the fan to discharge air in a repeating pattern of directions. Oscillation may be simple oscillation or complex oscillation. Within the context of a fan, a simple oscillation is a motion wherein the fan rotational axis sweeps through an arc, subsequently moving in reverse direction through the same arc, returning to its original position.

Where plural oscillation mechanisms act simultaneously on the fan, then the fan axis moves through a complex motion, there being orthogonal motions responsive to all oscillation units. For example, if one oscillation mechanism moves the fan axis through an arc about one axis of oscillation, and a second oscillation mechanism simultaneously through an arc about an axis of oscillation perpendicular to the first axis of oscillation, then the resultant motion exhibited by the fan will be frustoconical, or a similar complex motion.

Fan 100 of the embodiment of FIG. 2 shows a fan blade 126 mounted to shaft 128 of motor 130. Motor 130 is supported journaled at 132 on a carriage 134. When oscillation mechanism 122 operates, motor 130 and fan blade 126 oscillate in a vertical plane around a horizontal axis 136. Base 112 is rigidly secured to column 114, so that motor 130 and fan 126 are held erect relative to base 112.

Oscillation mechanism 122 comprises a tab 138 for secure mounting to motor 130, an oscillation motor 140, a gearbox 142, and a crank 144 having an offset crank arm 146, crank 144 drivingly connected to motor 140 by gearbox 142. It is not absolutely necessary to provide a gearbox. Gearbox 142 is provided where it is necessary to modify motor speeds and torques to drive the crank of an oscillation mechanism at desired speeds.

Arm 146 penetrates a groove 148 formed in a member of carriage 134. When oscillation motor 140 operates, groove 148 accommodates horizontal motion of arm 146. However, vertical motion is not accommodated, and motor 130 and all components fixed solidly thereto oscillate about axis 136, sweeping through a vertical plane.

Thus, it is seen that motor 130 and its associated fan 126 are oscillated in a vertical plane when oscillation mechanism 122 operates, motor 130 oscillating relative to carriage 134. It is desired that fan 126 also oscillate in a horizontal plane. This is accomplished by causing fan 126, motor 130, and carriage 134 to oscillate as a unit about vertical axis 150.

Fan 100 is supported on base 112 by a column 114. Carriage 134 is supported at the top of column 114, and is caused to oscillate in the horizontal plane by the following arrangement. Column 114 has a fixed, immobile portion 152, and a mobile portion 154 rotatably secured to portion 152. A joint 156 secures portion 154 to portion 152 joint 156 has ball bearings 158 and mutually connected bearing races 160 and 162. Bearing race 160 is fixed to immobile column portion 152, and is therefore stationary. Race 162 is fixed to mobile portion 154, and therefore can rotate relative to race 160 and stationary column portion 152.

A second oscillation mechanism 124 causes carriage 134 to oscillate relative to column immobile portion 152. Oscillation mechanism 124 has components equivalent to those of oscillation mechanism 122. Although the basic principle of operation is similar, orientation of mechanism 124 is modified as shown in this Figure so that oscillation occurs about vertical axis 150. Offset crank arm 164 of mechanism 124 engages groove 166 of a tab 168 fixed to the immobile portion 152 of column 114. Groove 166 is arranged to provide vertical accommodation of crank arm 164. No horizontal accommodation is provided by groove 166, so that when crank arm 164 moves, carriage 134 must react by oscillating in a horizontal plane about vertical axis 150.

In this embodiment, fan motor 130 and oscillation mechanisms 122 and 124 are each independently controlled. Three push button switches 170 are provided to control the respective motor for each function. Electrical power is supplied to the respective motors from cord and plug assembly 172 by electrical conductors 174 which preferably pass through the hollow center of column 114. The conductors are sufficiently long and flexible to accommodate oscillation.

The push buttons of switches 170 are located on base 112. This causes the controls of fan 100 to be maintained in a constant location independent of tilting of fan 126 and motor 130.

Figure 3:
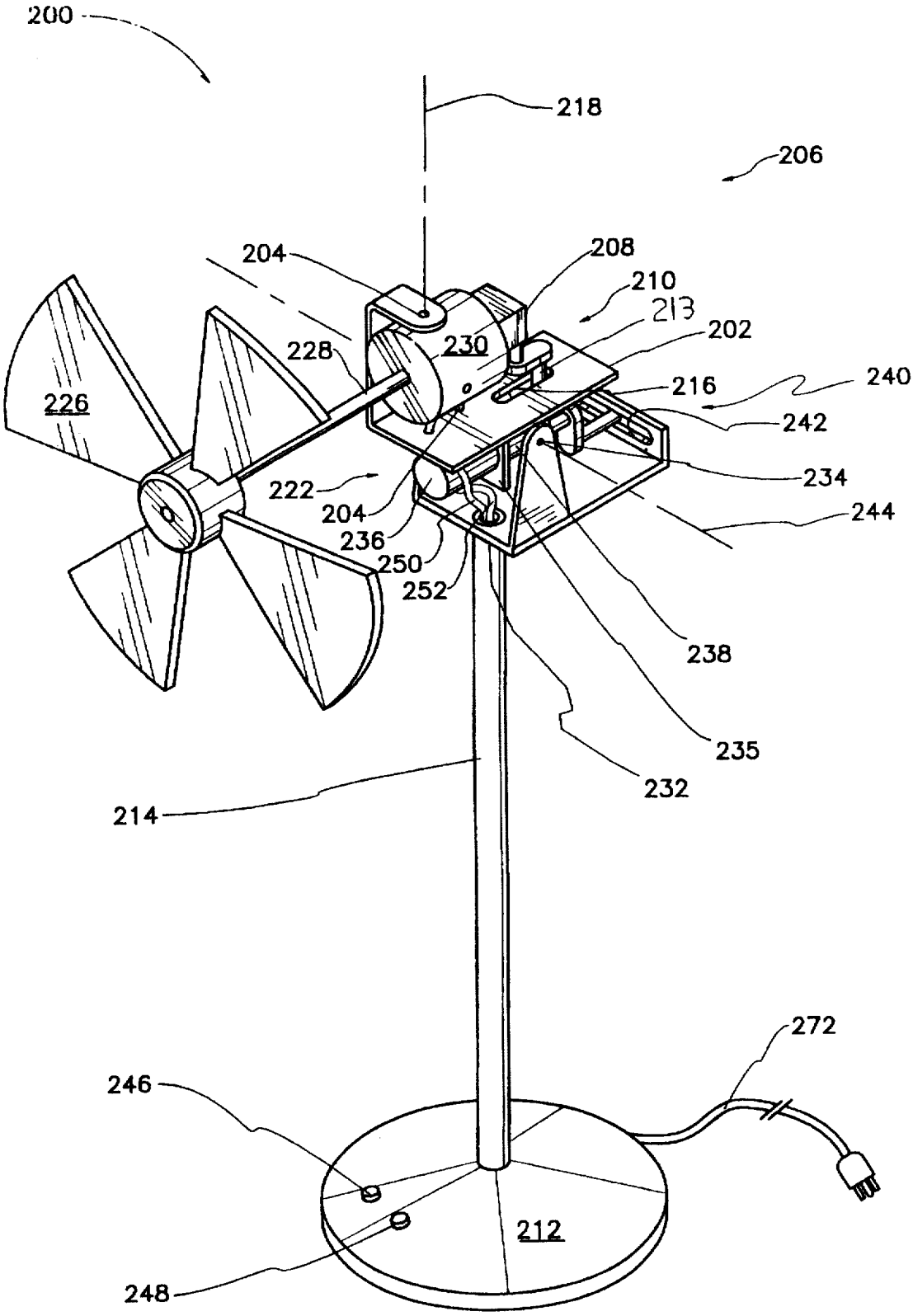
FIG. 3 is a perspective view of an alternative embodiment of the invention wherein the fan motor powers one oscillation mechanism.

Referring now to FIG. 3, it would be possible to eliminate a motor by having one oscillation mechanism powered by the fan motor. In this embodiment, fan 200 has many components similar to those of fan 100 of FIG. 2. The components which are essentially similar in function to those of fan 100 include a base 212, column 214, fan 226, motor shaft 228, and motor 230.

In fan 200, supporting structure for motor 230 is modified from the design of fan 100. It is contemplated that oscillation in a horizontal plane will be in greater demand than will be oscillation in a vertical plane. Therefore, since fan operation will result in oscillation in this embodiment, fan motor 230 is arranged to provide horizontal oscillation.

Fan motor 230 is supported on a carriage 202, and is journaled at two pivot points, as indicated at 204. An oscillation mechanism 206 including gear box 208 and crank 210 has an offset crank arm 213 which rides in groove 216 formed in a member fixed to carriage 202. Shaft 228 of fan motor 230 extends into gear box 208, so that no separate motor is required to operate oscillation mechanism 206. Operation of motor 230 both rotates fan 226 and also oscillates fan 226 about vertical axis 218.

Carriage 202 is pivotally supported on clevis frame 232 at two points, only one point 234 being visible in this view. Clevis frame 232 is solidly fixed to column 214. Oscillation mechanism 222 is attached to the bottom side of carriage 202 by a tab or bracket 235, and includes a motor 236, gear box 238, and crank 240. Crank 240 engages groove 242 formed in a solid member of clevis frame 232. Operation of oscillation mechanism 222 causes carriage 202 to oscillate in a vertical plane about horizontal axis 244.

Only two controls are required to operate fan 200 since there are only two motors 230, 236. Controls in this embodiment are well known capacitance type touch responsive switches, represented by touch pads 246, 248. Unlike a push button, which requires movement to a certain point to operate, touch responsive controls respond merely to contact, which alters capacitance of internal circuit components (not shown). The touch responsive switches energize a respective motor 230 or 236 through respective conductors 250, 252. Power is supplied to fan 200 by plug and cord assembly 272.

Figure 4:
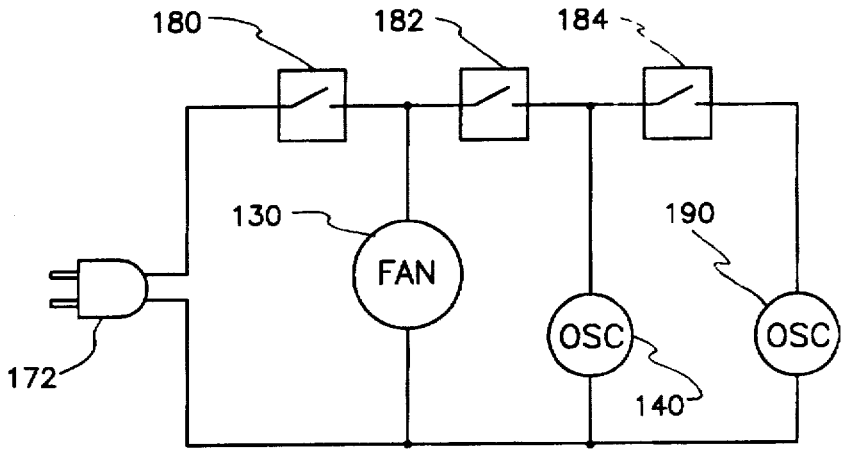
FIGS. 4 and 5 are electrical schematic diagrams of, respectively, the embodiments of FIG. 2 and FIG. 3.

FIG. 4 shows an electrical schematic for fan 100 of FIG. 2. A switch 180 controls power to fan motor 130 and also to switches 182, 184 controlling oscillation motors 140, 190. This arrangement prevents pointless oscillation should fan motor 130 not be switched on. Each switch 180, 182, or 184 is controlled by one push button 170 shown in FIG. 2.

Figure 5:
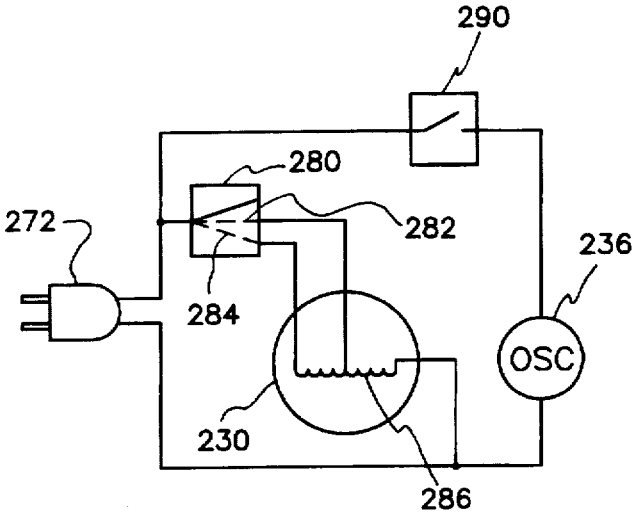

FIG. 5 shows an electrical schematic for fan 200 of FIG. 3. Touch pad 246 (see FIG. 3) activates a three position switch 280 in turn controlling fan motor 230. In one position, fan motor 230 is deenergized. In a second position, indicated at 282, and a third position, indicated at 284, motor winding 286 is energized appropriately to run at different speeds in well known fashion. Touch pad 248 (see FIG. 3) activates a switch 290 controlling oscillation motor 236 in on-off fashion.

Figure 6:
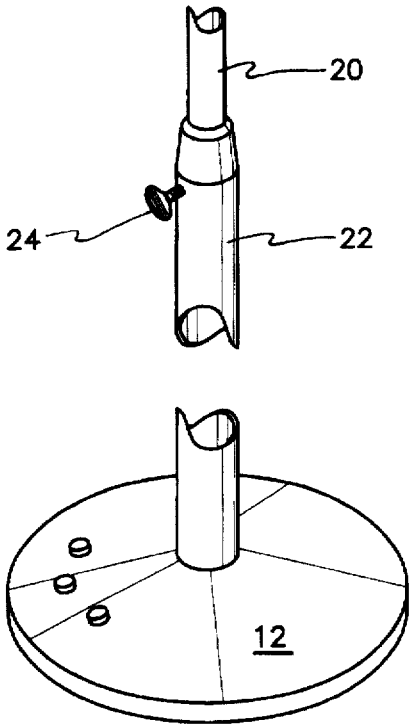
FIG. 6 is a perspective detail view of an alternative embodiment of the central column, showing height adjustment.

FIG. 6 illustrates optional adjustment of vertical height of fan 10. Column 14 includes inner and outer telescoping sleeves 20, 22. A threaded screw member 24 maintains the two sleeves 20, 22 in their selected positions.

Figure 7:
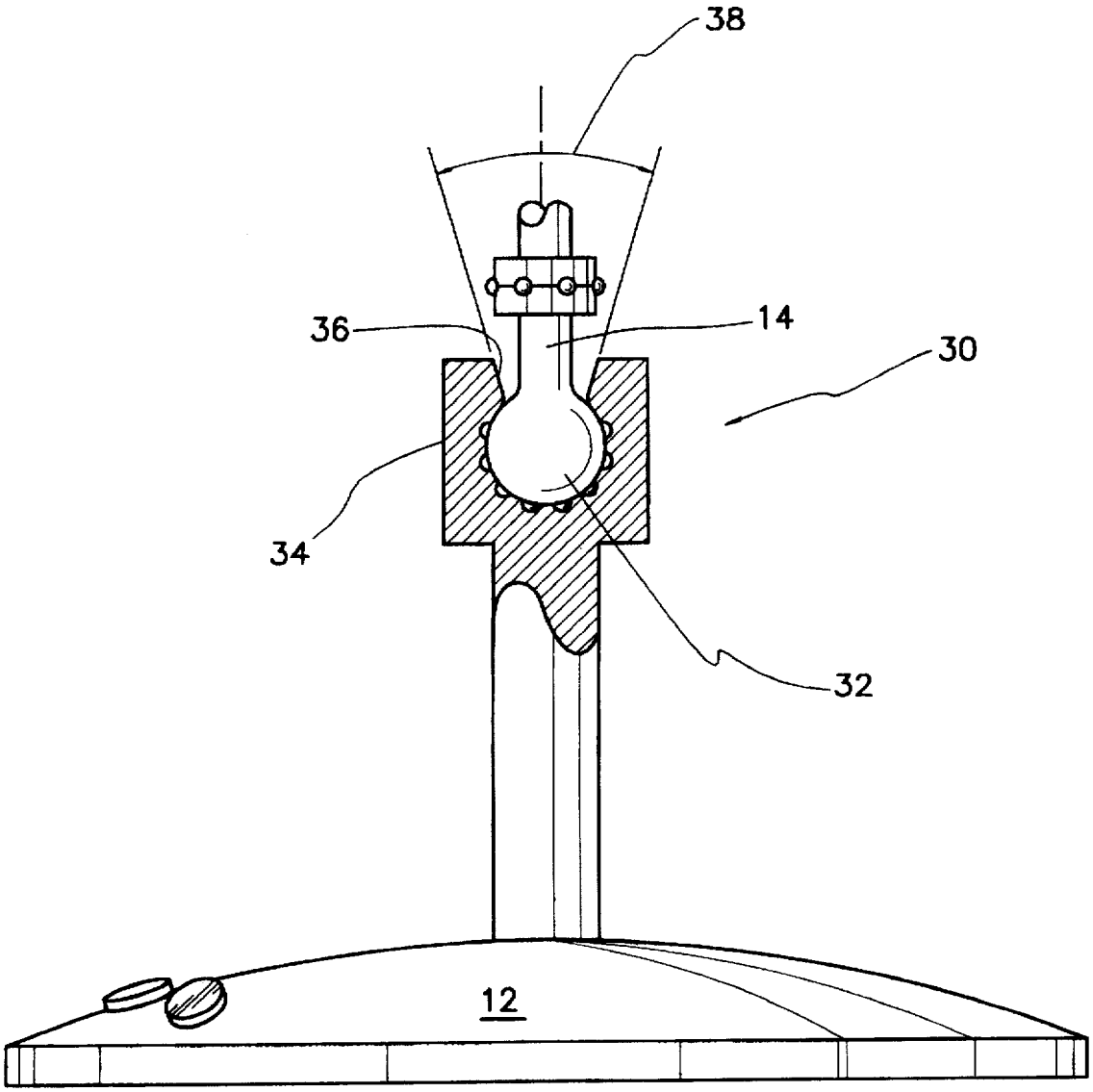
FIG. 7 is a side elevational, partly cross sectional view of an alternative embodiment of the central column, illustrating a tilting feature.

FIG. 7 illustrates further features of fan 10 (shown in its entirety in FIG. 1). Tilting of motor 16 (see FIG. 1) with respect to base 12 is enabled by a joint 30. Joint 30 includes a ball 32 and socket 34. Inclined walls 36 formed in socket 34 limits tilting to angle 38 by interfering with column 14. Excessive tilting which might upset balance of fan 10 is thus avoided.

It is also apparent from FIG. 7 that base 12 provides structure for supporting fan 10 (see FIG. 1) on a horizontal environmental surface by providing a flat bottom surface. This or equivalent structure, such as legs (not shown), is provided for portable applications of fan 10. In stationary applications, such as wall mounting, it is preferred that a suitable bracket (not shown) or other structure for accepting fasteners be provided.

I claim:

1. A fan comprising:

means for supporting said fan on an environmental surface;

a fan motor and fan blade assembly for propelling air, means for mounting said fan motor and fan blade assembly pivotally on said means for supporting said fan on an environmental surface, and oscillation means for oscillating said fan motor and fan blade assembly about a vertical axis and a horizontal axis with respect to said means for supporting said fan on an environmental surface, said oscillation means comprising a first oscillation mechanism including said fan motor drivingly connected thereto for oscillating said fan motor and fan blade assembly about said vertical axis in a horizontal plane, and a second oscillation mechanism including a second motor drivingly connected thereto for oscillating said fan motor and fan blade assembly about said horizontal axis in a vertical plane.

2. The fan according to claim 1, further comprising an electrical circuit having a first push button control controlling said fan motor and a second push button control controlling said second oscillation mechanism.

3. The fan according to claim 1, further comprising an electrical circuit having a first touch responsive control controlling said first oscillation mechanism and a second touch responsive control for controlling said second oscillation mechanism.

4. The fan according to claim 1, said means for supporting said fan on an environmental surface further comprising means for tilting said fan motor and fan blade assembly, and said fan further comprising an electrical circuit including a first control for controlling said first oscillation mechanism and a second control for controlling said second oscillation mechanism, said first control and said second control disposed upon said means for supporting said fan on an environmental surface, whereby said first control and said second control are maintained in a constant location independent of tilting of said fan motor and fan blade assembly.

5. The fan according to claim 1, further comprising means for tilting said fan motor and fan blade assembly, and means for limiting tilt of said fan motor and fan blade assembly, whereby said fan motor and fan blade assembly is prevented from tilting excessively.

6. The fan according to claim 1, said means for supporting said fan on an environmental surface comprising a flat bottom surface for supporting said fan on a flat, horizontal surface, said means for supporting said fan on an environmental surface having means for holding said fan motor and fan blade erect.

7. The fan according to claim 6, said means for holding said fan erect further comprising a column having means for selectively adjusting vertical height, whereby said height of said motor and fan blade assembly above said base is adjustable.

8. A fan according to claim 1, wherein said first oscillation mechanism further includes a gear box having an input and an output end, said input end being operatively connected to said fan motor;

a crank having an offset crank arm, said crank being operatively connected to said gear box output end;

a fixed member fixedly secured to said fan and having a groove formed therein, said offset crank arm being traversable within said groove.

9. A fan comprising:

means for supporting said fan on an environmental surface;

a fan motor and fan blade assembly for propelling air;

means for mounting said fan motor and fan blade assembly pivotally on said means for supporting said fan on an environmental surface; and oscillation means for oscillating said fan motor and fan blade assembly about two different axes with respect to said means for supporting said fan on an environmental surface, said oscillation means comprising;

a first oscillation mechanism including said fan motor drivingly connected thereto for oscillating said fan motor and fan blade assembly about one of said two axes;

a gear box having an input and an output end, said input end being operatively connected to said fan motor, a crank having an offset crank arm, said crank being operatively connected to said gear box output end, a fixed member fixedly secured to said fan and having a groove formed therein, said offset crank arm being traversable within said groove, and said oscillation means further comprising a second oscillation mechanism including a second motor drivingly connected thereto for oscillating said fan motor and fan blade assembly about the other of said two axes.

* * * * *